US011718923B2

(12) United States Patent
Sato

(10) Patent No.: US 11,718,923 B2
(45) Date of Patent: Aug. 8, 2023

(54) FILM FORMING METHOD FOR FORMING METAL FILM AND FILM FORMING APPARATUS FOR FORMING METAL FILM

(71) Applicant: TOYOTA JIDOSHA KABUSHIKI KAISHA, Toyota (JP)

(72) Inventor: Yuki Sato, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/804,717

(22) Filed: May 31, 2022

(65) Prior Publication Data

US 2022/0380923 A1 Dec. 1, 2022

(30) Foreign Application Priority Data

Jun. 1, 2021 (JP) ..... 2021-092162

(51) Int. Cl.

| | |
|---|---|
| ***C25D 5/06*** | (2006.01) |
| ***C25D 17/14*** | (2006.01) |
| ***C25D 5/00*** | (2006.01) |
| ***C25D 21/12*** | (2006.01) |
| ***C25D 17/00*** | (2006.01) |

(52) U.S. Cl.

CPC ..... *C25D 5/003* (2013.01); *C25D 5/06* (2013.01); *C25D 17/002* (2013.01); *C25D 17/14* (2013.01); *C25D 21/12* (2013.01)

(58) Field of Classification Search

CPC ..... C25D 17/002; C25D 5/003; C25D 5/06; C25D 17/14

See application file for complete search history.

(56) References Cited

U.S. PATENT DOCUMENTS

| | | | | |
|---|---|---|---|---|
| 4,348,267 | A * | 9/1982 | Shimamura | C25D 5/08 204/278 |
| 2004/0016636 | A1* | 1/2004 | Yang | C25D 17/001 257/E21.175 |
| 2016/0265129 | A1* | 9/2016 | Hiraoka | C25D 5/06 |
| 2016/0298254 | A1* | 10/2016 | Godfrey | C25D 11/04 |

FOREIGN PATENT DOCUMENTS

| | | |
|---|---|---|
| JP | 6056987 B2 | 1/2017 |
| JP | 2020109215 A | 7/2020 |
| JP | 2020132948 A | 8/2020 |

* cited by examiner

*Primary Examiner* — Hosung Chung

(74) *Attorney, Agent, or Firm* — Dickinson Wright, PLLC

(57) ABSTRACT

Provided is a method for forming a metal film capable of forming a homogeneous metal film having a uniform film thickness by stably ensuring a fluid pressure of an electrolytic solution during film formation. The method places a substrate on a mount base. While sucking a gas between the substrate and a porous film through which the electrolytic solution can pass from a suction port of a suction passage formed on the mount base, the method brings the porous film into contact with the surface of the substrate. The method interrupts the suction passage while the porous film contacts the surface of the substrate. While interrupting the suction passage, the method allows the electrolytic solution to pass through the porous film while pressing the porous film against the surface of the substrate with a fluid pressure of the electrolytic solution and deposits metal from metal ions in the passed electrolytic solution on the surface of the substrate, thereby forming the metal film.

3 Claims, 6 Drawing Sheets

FILM FORMING METHOD FOR FORMING METAL FILM AND FILM FORMING APPARATUS FOR FORMING METAL FILM

CROSS REFERENCE TO RELATED APPLICATIONS

The present application claims priority from Japanese patent application JP 2021-092162 filed on Jun. 1, 2021, the entire content of which is hereby incorporated by reference into this application.

BACKGROUND

Technical Field

The present disclosure relates to a film forming method and a film forming apparatus for forming a metal film derived from metal ions contained in an electrolytic solution on a surface of a substrate by depositing metal on the surface of the substrate by electroplating or electroless plating.

Background Art

As the film forming method for forming a metal film on a surface of a substrate, for example, a method that uses a solid electrolyte membrane for forming a metal film by electroplating is proposed in JP 6056987 B. Specifically, in the film forming method disclosed in JP 6056987 B, an electrolytic solution is allowed to pass through a solid electrolyte membrane from one side of the solid electrolyte membrane while the solid electrolyte membrane is pressed against the surface of a substrate with a fluid pressure of the electrolytic solution, and metal from metal ions contained in the passed electrolytic solution is deposited on the surface of the substrate by electroplating. Further, in the film forming method disclosed in JP 6056987 B, during film formation, the solid electrolyte membrane is sucked from the substrate side such that the solid electrolyte membrane is brought into intimate contact with the substrate.

SUMMARY

When the solid electrolyte membrane is a porous film, however, forming a film while sucking the porous film as described in JP 6056987 B may cause the electrolytic solution to leak into the substrate side through the porous film due to the sucking. If the electrolytic solution keeps leaking into the substrate side during film formation, a stable fluid pressure may no longer be ensured. As a result, it may be difficult to form a homogeneous metal film having a uniform film thickness.

The present disclosure has been made in view of the foregoing, and provides a film forming method and a film forming apparatus for forming a metal film capable of forming a homogeneous metal film having a uniform film thickness by stably ensuring a fluid pressure of an electrolytic solution during film formation.

In view of the foregoing, the film forming method for forming a metal film according to the present disclosure is a film forming method for forming a metal film from metal ions contained in an electrolytic solution on a surface of a substrate by depositing metal on the surface of the substrate by electroplating or electroless plating. The film forming method includes at least: placing the substrate on a mount base; while sucking a gas between the substrate and a porous film from a suction port of a suction passage formed on the mount base, moving the porous film toward the substrate and bringing the porous film into contact with the surface of the substrate; interrupting the suction passage in a state where the porous film is in contact with the surface of the substrate; and in a state where the suction passage is interrupted, allowing the electrolytic solution to pass through the porous film while the porous film is pressed against the substrate with a fluid pressure of the electrolytic solution and depositing the metal from the metal ions contained in the passed electrolytic solution on the surface of the substrate, thereby forming the metal film on the surface of the substrate.

According to the film forming method for forming a metal film of the present disclosure, before forming a metal film, the substrate is placed on the mount base, and the porous film is brought into contact with the surface of the substrate while sucking a gas between the substrate and the porous film from the suction port of the suction passage formed on the mount base. This can prevent the gas (air) from being captured in between the substrate and the porous film and uniformly bring the porous film into contact with the surface of the substrate. Here, since the suction passage is interrupted in a state where the porous film is in contact with the surface of the substrate, the suction of the gas from the suction port is released. Consequently, while forming a metal film, even if the electrolytic solution is allowed to pass through the porous film while the porous film is pressed against the surface of the substrate with a fluid pressure of the electrolytic solution, it is possible to prevent the passed electrolytic solution from continuously flowing to the suction passage from the suction port. In this way, it is possible to uniformly press the porous film against the surface of the substrate in a state where the fluid pressure of the electrolytic solution is stably maintained and to uniformly supply the passed electrolytic solution to the surface of the substrate, and thus it is possible to form a homogeneous metal film having a more uniform film thickness on the surface of the substrate.

In some embodiments, after the forming the metal film, the interrupted suction passage is allowed to be communicated to atmosphere and the porous film is separated from the substrate after the suction passage is communicated to the atmosphere.

According to this embodiment, as described above, the pressure in the suction passage may be maintained at a negative pressure due to the suction of a gas after the suction passage is interrupted in a state where the porous film is in contact with the surface of the substrate and until film formation is completed. Then, after the forming the metal film, the interrupted suction passage is allowed to be communicated to atmosphere so that the pressure in the suction passage can be reset to the atmospheric pressure. Consequently, after the forming the metal film, it is possible to reduce the likelihood that the porous film is less likely to be separated from the substrate due to the negative pressure in the suction passage.

In some embodiments, in the bringing the porous film into contact with the surface of the substrate, the electrolytic solution having been sucked into the suction passage together with the gas during suction of the gas is separated from the gas. According to this embodiment, the electrolytic solution can be collected and reused by separating, from the gas, the electrolytic solution sucked into the suction passage together with the gas.

This specification discloses a film forming apparatus for suitably performing the above-described film forming method for forming a metal film. The film forming apparatus for forming a metal film of the present disclosure is a film forming apparatus for forming a metal film from metal ions contained in an electrolytic solution on a surface of a substrate by depositing metal on the surface of the substrate by electroplating or electroless plating. The film forming apparatus includes at least: a housing configured to store the electrolytic solution; a porous film attached to the housing so as to seal the electrolytic solution stored in the housing and to be opposed to the substrate; a fluid pressure adjusting device configured to adjust a fluid pressure of the electrolytic solution stored in the housing; a mount base configured to have the substrate placed thereon, the mount base including a suction passage with a suction port for sucking a gas between the substrate and the porous film; an elevating device configured to move the housing upward and downward with respect to the mount base; a suction device coupled to the suction passage via an on-off valve and configured to suck a fluid in the suction passage; and a control device configured to control at least adjustment of a fluid pressure by the fluid pressure adjusting device, upward and downward movement of the elevating device, suction by the suction device, and opening and closing of the on-off valve. The control device includes at least: a suction execution unit configured to execute suction by the suction device in a state where the on-off valve is open; a lowering control unit configured to control lowering of the housing by the elevating device to a position where the porous film comes into contact with the substrate during suction by the suction device; a valve-closing control unit configured to control the on-off valve to be closed after the porous film comes into contact with the substrate; a fluid pressure increasing unit configured to make the fluid pressure adjusting device increase the fluid pressure of the electrolytic solution after the on-off valve is closed; and a film-formation execution unit configured to form the metal film on the surface of the substrate while maintaining the increased fluid pressure.

According to the film forming apparatus for forming a metal film of the present disclosure, while the suction execution unit executes suction by the suction device in a state where the on-off valve is open, the lowering control unit controls lowering (lowering amount) of the housing by the elevating device to the position where the porous film comes into contact with the substrate. This can prevent the gas (air) from being captured in between the substrate and the porous film and uniformly bring the porous film into contact with the surface of the substrate. Next, the valve-closing control unit controls the on-off valve to be closed after the porous film comes into contact with the substrate. Thus, the suction of the gas from the suction port is released.

Next, after the on-off valve is closed, the fluid pressure increasing unit increases the fluid pressure of the electrolytic solution in the housing by using the fluid pressure adjusting device. Consequently, while forming a metal film, even if the electrolytic solution is allowed to pass through the porous film while the porous film is pressed against the surface of the substrate with a fluid pressure of the electrolytic solution in the housing, it is possible to prevent the passed electrolytic solution from continuously flowing to the suction passage from the suction port. In this way, it is possible to uniformly press the porous film against the surface of the substrate in a state where the fluid pressure of the electrolytic solution is stably maintained and to uniformly supply the passed electrolytic solution to the surface of the substrate, and thus it is possible to form a homogeneous metal film having a more uniform film thickness on the surface of the substrate by the film-formation execution unit.

In some embodiments, the suction passage is coupled to a communication passage for allowing the suction passage to be communicated to atmosphere; the communication passage is provided with an atmosphere release valve for allowing the suction passage to be communicated to atmosphere and for interrupting the suction passage communicated to atmosphere; and the control device further includes: a communication interrupting unit configured to control the atmosphere release valve to be closed to interrupt the suction passage communicated to atmosphere before the suction execution unit starts suction and until the lowering control unit brings the porous film into contact with the substrate; a communication control unit configured to control the atmosphere release valve to be open to allow the suction passage to be communicated to atmosphere after the film-formation execution unit forms the metal film; and a lifting control unit configured to control lifting of the housing by the elevating device after the suction passage is communicated to atmosphere by the communication control unit.

According to this embodiment, before suction is started and until the porous film comes into contact with the substrate, the communication interrupting unit controls the atmosphere release valve to be closed to interrupt the suction passage communicated to atmosphere. This allows stable suction by the suction device since the suction passage is not communicated to atmosphere. After the film-formation execution unit forms a metal film, the communication control unit controls the atmosphere release valve to be open to allow the suction passage to be communicated to atmosphere. This can reset the pressure in the suction passage to the atmospheric pressure after film formation, even if it is maintained at a negative pressure due to the suction of a gas after the suction passage is interrupted and until film formation is completed. Consequently, even if lifting of the housing by the elevating device is controlled, it is possible to reduce the likelihood that the porous film is less likely to be separated from the substrate due to the negative pressure in the suction passage.

In some embodiments, the film forming apparatus further includes: a gas-liquid separator provided downstream of the on-off valve and configured to separate the electrolytic solution from the gas; and a collection tank configured to collect the separated electrolytic solution.

According to this embodiment, it is possible to separate, from the gas, the electrolytic solution sucked into the suction passage together with the gas via the gas-liquid separator. Since the separated electrolytic solution is collected in the collection tank, the electrolytic solution stored in the collection tank can be reused. In particular, when the electrolytic solution containing a gas is supplied to the housing for reuse, it is difficult to stably increase the fluid pressure of the electrolytic solution since the gas is a compressible fluid. In this embodiment, however, it is possible to supply the electrolytic solution separated from the gas to the housing and to stably increase the pressure of the electrolytic solution in the housing during film formation.

According to the film forming method and the film forming apparatus for forming a metal film of the present disclosure, it is possible to form a homogeneous metal film having a uniform film thickness by stably ensuring a fluid pressure of an electrolytic solution during film formation.

DETAILED DESCRIPTION

Hereinafter, first and second embodiments according to the present disclosure will be described with reference to FIG. 1 to FIG. 5. It should be noted that dashed lines in FIG. 1, FIG. 4, and FIG. 5 express signal lines of control signals output from a control device 50 and signal lines of signals output from a distance measuring sensor 50A and a pressure measuring sensor 50B.

First Embodiment

A film forming method and a film forming apparatus 1 for forming a metal film F of the present embodiment are applied when forming a metal film F derived from metal ions contained in an electrolytic solution S on a surface of a substrate W by depositing metal on the surface of the substrate W by electroless plating. Herein, the electroless plating is a film deposition (forming) method for forming a film through chemical reduction, in contrast to electroplating for electrolytic deposition by means of electricity. The electroless plating includes, for example, displacement plating that uses a difference in ionization tendency between a metal forming a substrate and metal ions contained in an electrolytic solution and autocatalytic reduction plating that uses a reducing agent having a reduction capability.

Hereinafter, first, the film forming apparatus 1 for forming the metal film F of the present embodiment will be described with reference to FIG. 1 and FIG. 2, and then the film forming method for forming the metal film F of the present embodiment will be described with reference to FIG. 1 to FIG. 4.

1. Regarding Film Forming Apparatus 1

Figure 1:
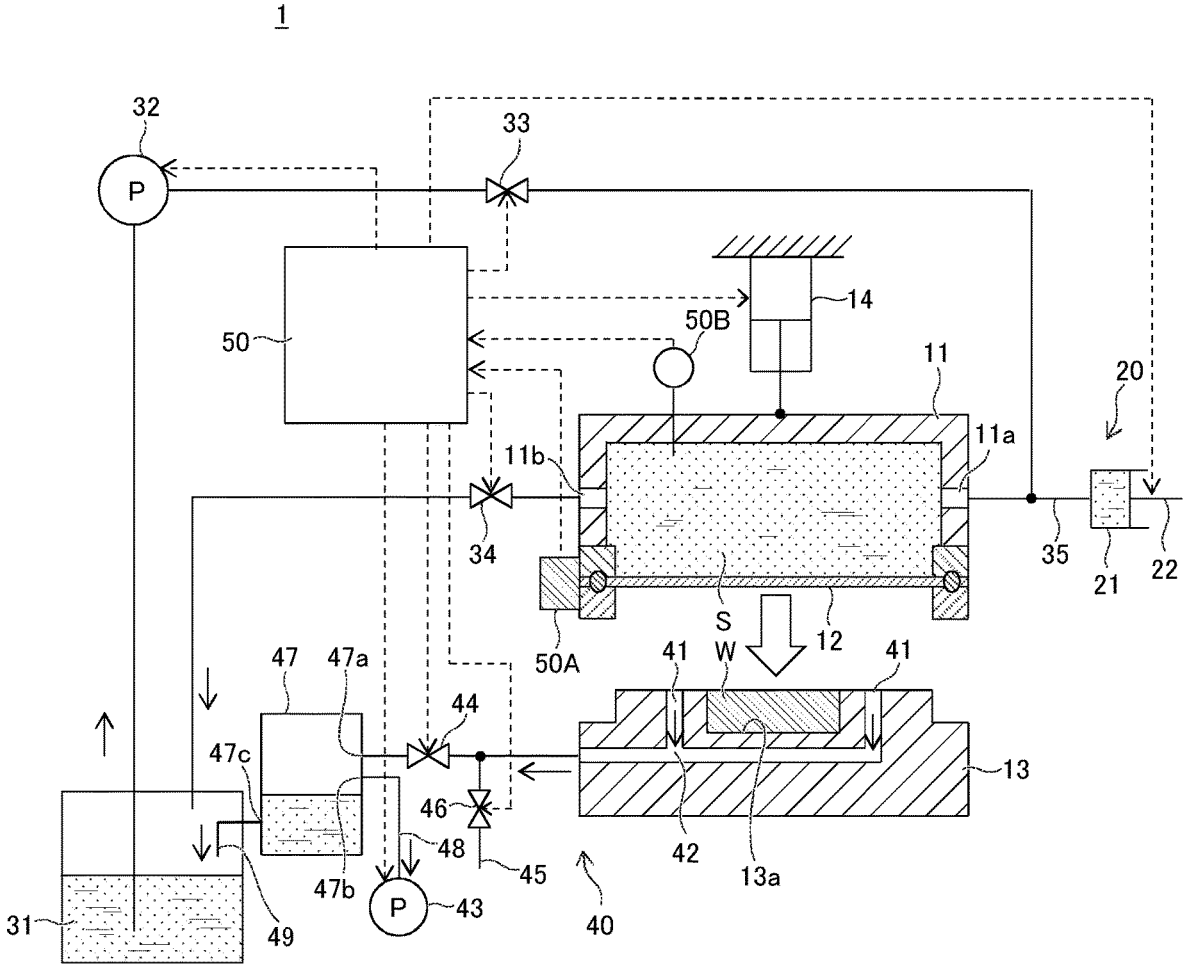
FIG. 1 is a schematic cross-sectional view of a film forming apparatus for forming a metal film according to a first embodiment of the present disclosure, illustrating the state of the film forming apparatus having a substrate mounted thereon.

FIG. 1 is a schematic cross-sectional view of the film forming apparatus 1 for forming the metal film F according to the first embodiment of the present disclosure, illustrating the state of the film forming apparatus 1 having a substrate W mounted thereon. FIG. 2 is a block diagram of the control device 50 of the film forming apparatus 1 shown in FIG. 1.

The film forming apparatus 1 of the present embodiment is a film forming apparatus (plating apparatus) for forming the metal film F via a porous film 12 by electroless plating, and is used when forming the metal film F on the surface of the substrate W. The film forming apparatus 1 is also used when continuously forming the metal film F on the surfaces of a plurality of substrates W.

As for the substrate W, when the electroless plating is displacement plating, a metal material made of a less noble metal (i.e., a metal at a higher position in the electrochemical series) than the metal ions contained in the electrolytic solution S may be used for the substrate W. In addition, a layer made of a less noble metal than the metal ions contained in the electrolytic solution S may be formed on the surface of the substrate body of the substrate W. In this case, for the substrate body, a more noble metal material than the metal ions contained in the electrolytic solution S or a resin material, and the like may be used. In one example, when the metal ions contained in the electrolytic solution S are Au ions, the substrate W may have a Ni plating layer formed on the surface of the substrate body made of Cu.

When the electroless plating is autocatalytic reduction plating, as long as the material of the substrate W has a catalytic effect of facilitating oxidation of a reducing agent, a metal material or a resin material, and the like may be used for the substrate W. In addition, a layer made of a metal serving as a catalyst may be formed on the surface of the substrate body of the substrate W. In this case, a metal material and a resin material not having a catalytic effect may be used for the substrate body of the substrate W. In one example, when the metal ions contained in the electrolytic solution S are Ni ions, the substrate W may have a Pd plating layer serving as a catalyst formed on the surface of the substrate body made of Cu.

As shown in FIG. 1, the film forming apparatus 1 includes at least a housing 11, a porous film 12, a mount base 13, an elevating device 14, a fluid pressure adjusting device 20, a suction unit 40, and a control device 50.

The housing 11 is configured to store an electrolytic solution. The porous film 12 is attached to the housing 11 so as to seal the electrolytic solution S stored in the housing 11 and to be opposed to the substrate W (specifically, the mount base 13). More specifically, the porous film 12 is attached to the housing 11 such that one of the surfaces of the porous film 12 contacts the electrolytic solution S stored in the housing 11 and the other one of the surfaces of the porous film 12 faces the substrate W. The porous film 12 is a film that allows the electrolytic solution S to pass therethrough in the thickness direction and has a plurality of pores through which the electrolytic solution S can pass.

The thickness of the porous film 12 may be, for example, 10 μm or more and 200 μm or less, and specifically, 20 μm or more and 160 μm or less. The average pore diameter of the porous film 12 may be, for example, 0.1 μm or more and 100 μm or less, and the pore may be a micropore having an average pore diameter of 20 to 100 nm, for example. As long as the electrolytic solution S can pass through (permeate) the porous film 12 in the thickness direction via the pores of the porous film 12 by increasing the fluid pressure of the electrolytic solution S in the housing 11, the pore diameter of the porous film 12 is not particularly limited thereto.

In addition, in the present embodiment, the porous film 12 need not have an ion exchange functional group (a cation exchange functional group or an anion exchange functional group) like a solid electrolyte. Thus, the porous film 12 has almost no polarity and the metal ions contained in the electrolytic solution S can pass through the pores without being trapped in the porous film. Such a porous film 12 can be applied to any of the cases where the metal ions contained in the electrolytic solution S are cations, anions, or nonions. For the porous film 12, a polyolefin resin can be used. Examples of the polyolefin resin may include a polyethylene resin, a polypropylene resin, or a resin of mixture thereof.

Meanwhile, a solid electrolyte having an ion exchange functional group may be used for the porous film 12. As long as metal ions can pass through the solid electrolyte by bringing the solid electrolyte into contact with the electrolytic solution S and metal derived from the metal ions can be deposited on the surface of the substrate W, the solid electrolyte is not particularly limited. Examples of the solid electrolyte may include a fluorine-based resin, such as Nafion (registered trademark) available from DuPont, a hydrocarbon resin, a polyamide resin, or a resin having cation exchange functionality, such as Selemion (CM, CMD, CMF series) available from AGC Inc.

The electrolytic solution S is a solution supplied to one side of the porous film 12 and containing at least metal ions of the metal to be deposited for the metal film F by electroless plating. It should be noted that the electrolytic solution S for displacement plating or autocatalytic reduction plating is commercially available as a plating solution. Such a commercially available plating solution may be used for the electrolytic solution S.

When the electroless plating is displacement plating, the metal of the metal ions contained in the electrolytic solution S is a more noble metal (i.e., a metal at a lower position in the electrochemical series) than the material of the substrate W. For example, when the substrate W is made of Cu, the metal of the metal ions may be Ag, Pt, or Au, or the like.

When the electroless plating is autocatalytic reduction plating, the electrolytic solution S contains metal ions of the metal to be deposited for the metal film F and a reducing agent. Examples of the metal of the metal ions may include Ag, Pt, or Au, or the like, but are not limited thereto as long as the metal has a catalytic effect. Examples of the reducing agent may include hypophosphorous acid or dimethylamine borane. The electrolytic solution S may further contain a stabilizer, a complexing agent, and a reducing agent, for example.

As described above, the housing 11 includes a space for storing the electrolytic solution S and has the electrolytic solution S stored therein, and the porous film 12 is attached to the housing 11. The housing 11 is provided with a supply port 11*a* to supply the electrolytic solution S and a discharge port 11*b* to discharge the electrolytic solution S.

The mount base 13 is configured to have the substrate W placed thereon at a position opposed to the porous film 12. In the present embodiment, the mount base may have conductivity or nonconductivity. The mount base 13 has a suction passage 42 with a suction port 41. The suction port 41 and the suction passage 42 will be described later.

In addition, the mount base 13 includes a housing recess 13*a* for housing the substrate W. The housing recess 13*a* has a depth equal to the thickness of the substrate W. Accordingly, when the substrate W is housed in the housing recess 13*a*, the substrate W and the mount base 13 may be disposed such that the surface of the substrate W is flush with the surface of the mount base 13. This can reduce stress excessively applied to the porous film 12 during film formation.

Figure 4:
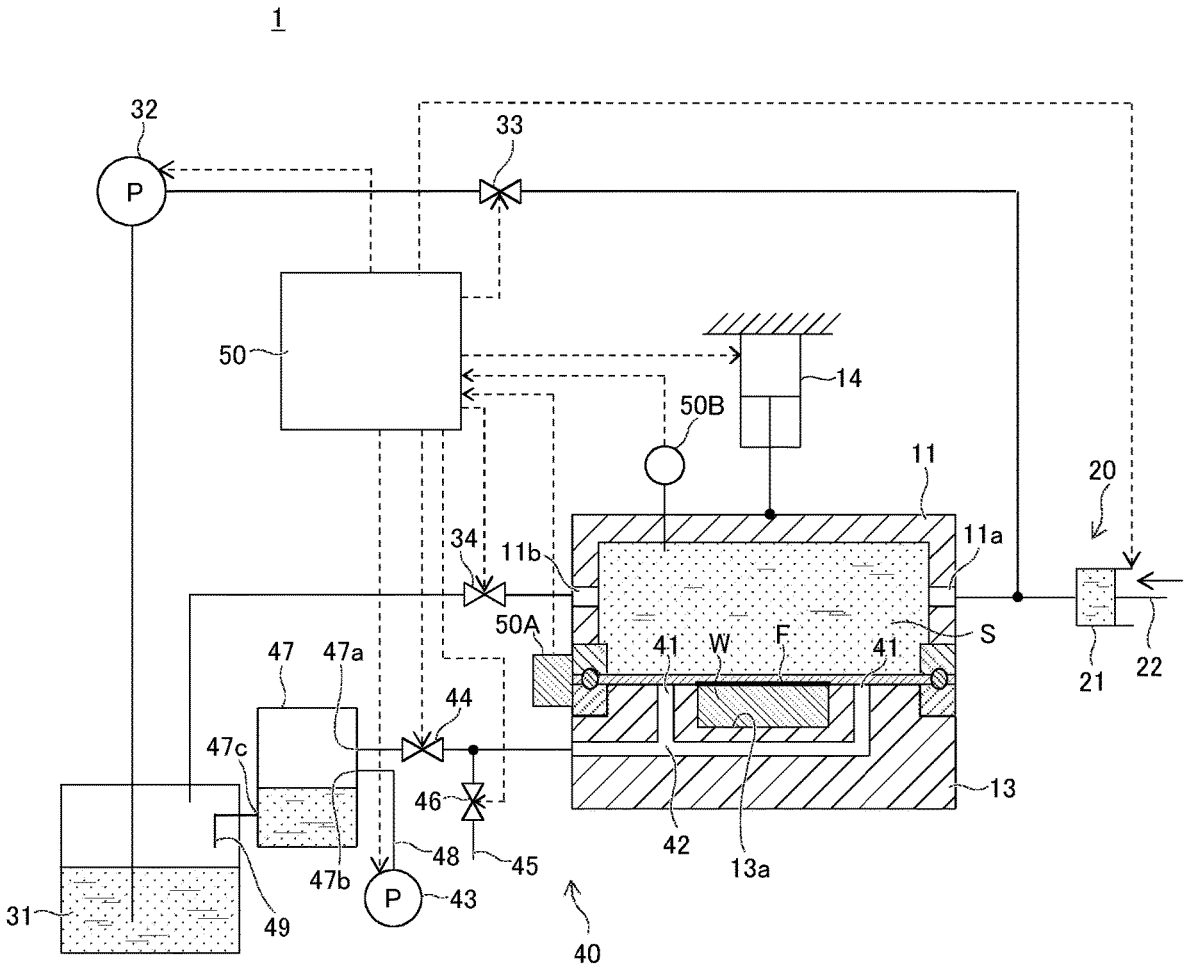
FIG. 4 is a schematic conceptual view illustrating a film forming step of forming a metal film shown in FIG. 3.

The elevating device 14 is configured to move the housing 11 upward and downward with respect to the mount base 13 (see FIG. 1, FIG. 4). In the present embodiment, the elevating device 14 is configured to move the housing 11 upward and downward between a position where the porous film 12 is spaced apart from the substrate W and a position where the porous film 12 comes into contact with the substrate W, and is disposed above the housing 11. As long as the elevating device 14 can move the housing 11 upward and downward, the elevating device 14 can be configured by a hydraulic or pneumatic cylinder, a motor-driven actuator, a linear guide and a motor, for example.

The fluid pressure adjusting device 20 is configured to adjust the fluid pressure of the electrolytic solution S stored in the housing 11. The fluid pressure adjusting device 20 includes a cylinder 21 and a piston 22 and is coupled to the supply port 11*a* of the housing 11 via a pipe 35 on the supply system side, which will be described later. The fluid pressure adjusting device 20 can adjust the fluid pressure of the electrolytic solution S stored in the housing 11 by moving the piston 22 back and forth with respect to the cylinder 21 as will be described later.

It should be noted that although the example of the fluid pressure adjusting device 20 including the cylinder 21 and the piston 22 is described herein, the fluid pressure adjusting device 20 is not limited thereto. For example, when a discharge valve 34 is a pressure control valve, the fluid pressure adjusting device 20 may pressurize the electrolytic solution S in the housing 11 with a predetermined pressure using the discharge valve 34 and a pressure pump 32 while supplying and discharging the electrolytic solution S as will be described later. However, to easily achieve high pressure, to improve precision in pressure control, and to suppress pulsation, the fluid pressure adjusting device 20 may include the cylinder 21 and the piston 22.

Furthermore, the film forming apparatus 1 of the present embodiment includes a collection tank 31 coupled to the supply port 11*a* and the discharge port 11*b* via the pipe 35. The pressure pump 32 is provided between the collection tank 31 and the supply port 11*a*. In addition, a supply valve 33 for interrupting the pipe 35 on the supply system side is provided between the pressure pump 32 and the supply port 11*a*, and the discharge valve 34 for interrupting the pipe 35 on the discharge system side is provided between the discharge port 11*b* and the collection tank 31.

The collection tank 31 is a tank that stores the electrolytic solution S and supplies the stored electrolytic solution S to the housing 11. The pressure pump 32 is a pump that sucks the electrolytic solution S from the collection tank 31 and pressure feeds the electrolytic solution S into the housing 11 via the supply port 11*a*. The supply valve 33 and the discharge valve 34 are valves for supplying and discharging the electrolytic solution S stored in the housing 11 in the open position and for ensuring the hermeticity of the housing 11 in the closed position. Examples of the supply valve 33 and the discharge valve 34 may include a solenoid valve.

The electrolytic solution S fed by the pressure pump 32 from the collection tank 31 passes through the supply valve 33 and flows into the housing 11 from the supply port 11*a*. Then, the electrolytic solution S introduced into the housing 11 flows through the housing 11 from the supply port 11*a* to the discharge port 11*b* to be discharged from the discharge port 11*b*, and returns to the collection tank 31 after passing through the discharge valve 34.

The suction unit 40 has a function of sucking a gas (for example, air) between the substrate W and the porous film 12 from the side of the mount base 13. This can prevent the gas from being captured in between the surface of the substrate W and the porous film 12. The suction unit 40 includes at least the suction passage 42 with the suction port 41, a suction device 43, and an on-off valve 44.

One end of the suction passage 42 is provided with a suction port 41. The portion including the suction port 41 of the suction passage 42 is formed on the mount base 13. The position, shape, and the number of the suction port 41 are not particularly limited as long as the gas between the substrate W and the porous film 12 can be sucked. For example, a plurality of suction ports 41 may be formed on the surface of the mount base 13 at regular intervals around the substrate W. The other end of the suction passage 42 is coupled to the suction device 43 via a gas-liquid separator 47 which will be described later. The gas-liquid separator 47 is coupled to the collection tank 31 for collecting the separated electrolytic solution S.

The suction device 43 is a device coupled to the suction passage 42 via the gas-liquid separator 47 and configured to suck a fluid (a gas and the electrolytic solution S) in the suction passage 42. The suction device 43 can suck the gas in the suction passage 42 by sucking the gas separated on the gas phase side of the gas-liquid separator 47. Examples of the suction device 43 may include a vacuum pump, but are not limited thereto as long as it can suck a fluid.

The suction passage 42 is provided with the on-off valve 44. The on-off valve 44 is provided between the suction port 41 and the gas-liquid separator 47 for interrupting the suction passage 42. When the on-off valve 44 is in the open position, suction by the suction device 43 can pass a fluid through the suction passage 42. Meanwhile, when the on-off valve 44 is in the closed position, the flow of the fluid in the suction passage 42 is interrupted.

In the present embodiment, the suction unit 40 further includes a communication passage 45, an atmosphere release valve 46, and the gas-liquid separator 47. The communication passage 45 is a passage communicated to atmosphere and coupled to the suction passage 42 between the suction port 41 and the on-off valve 44. The atmosphere release valve 46 is a valve (for example, solenoid valve) provided in the communication passage 45 for allowing the suction passage 42 to be communicated to atmosphere via the communication passage 45 and for interrupting the suction passage 42 communicated to atmosphere. When the atmosphere release valve 46 is in the open position, the suction passage 42 can be communicated to atmosphere via the communication passage 45. Meanwhile, when the atmosphere release valve 46 is in the closed position, the suction passage 42 communicated to atmosphere via the communication passage 45 is interrupted.

The gas-liquid separator 47 is a device provided downstream of the on-off valve 44 and having a function of separating a fluid mixture of a gas and the electrolytic solution S into a gas and the electrolytic solution S. The gas-liquid separator 47 has a space for storing a fluid, where a gas accumulates in the upper part and the electrolytic solution S accumulates in the lower part. In addition, the gas-liquid separator 47 is provided with a gas-liquid inlet port 47*a* that is coupled to the other end of the suction passage 42. In addition, a gas outlet port 47*b* and a liquid outlet port 47*c* are provided on the gas phase side and the liquid phase side of the gas-liquid separator 47, respectively. The gas outlet port 47*b* is coupled to the suction device 43 via the gas outlet passage 48. Meanwhile, the liquid outlet port 47*c* is coupled to the collection tank 31 via the liquid outlet passage 49.

In this suction unit 40, when the on-off valve 44 is in the open position, the suction passage 42 is communicated to the gas-liquid separator 47 and the suction device 43. At this time, the suction passage 42 is communicated to the gas-liquid separator 47 and the collection tank 31.

With the above-described configuration, as will be described later, when a gas is sucked into the suction passage 42 during suction, the sucked gas is sucked into the suction device 43 via the gas-liquid separator 47. Meanwhile, when the electrolytic solution S is sucked into the suction passage 42 together with the gas, the fluid mixture of the sucked gas and electrolytic solution S is separated into the gas and the electrolytic solution S by the gas-liquid separator 47. The separated gas is sucked into the suction device 43, and the separated electrolytic solution S is discharged to the collection tank 31. Since the discharged electrolytic solution S is supplied again to the inside of the housing 11, leaking electrolytic solution S can be efficiently collected.

In the present embodiment, the film forming apparatus 1 further includes a distance measuring sensor 50A, a pressure measuring sensor 50B, and a control device 50 to stop suction of the gas by the suction unit 40 during film formation.

The distance measuring sensor 50A is a displacement sensor, such as a proximity sensor, for measuring a distance between the porous film 12 and the substrate W, and is attached to the housing 11. Examples of the distance measuring sensor 50A may include a sensor utilizing infrared rays, electromagnetic waves, or magnetism. The pressure measuring sensor 50B is a sensor for measuring a pressure (fluid pressure) adjusted by the fluid pressure adjusting device 20, and is attached to the housing 11. The distance measuring sensor 50A and the pressure measuring sensor 50B are electrically coupled to the control device 50 such that the control device 50 receives, as signals, measurement values obtained by the distance measuring sensor 50A and the pressure measuring sensor 50B.

The control device 50 is a device configured to control at least the upward and downward movement of the elevating device 14, suction by the suction device 43, adjustment of the fluid pressure by the fluid pressure adjusting device 20, and opening and closing of the on-off valve 44. The control device 50 basically includes, as hardware, an operation unit, such as a CPU or the like, a storage unit, such as RAM, ROM, or the like. The operation unit calculates control signals to the suction device 43, the fluid pressure adjusting device 20, and the on-off valve 44 based on the signals of the distance measuring sensor 50A and the pressure measuring sensor 50B, and outputs the calculated signals. The storage unit stores, for example, a preset range of a predetermined distance between the porous film 12 and the substrate W and a preset range of an applied pressure (fluid pressure) during film formation, or the like.

In the present embodiment, the control device 50 is electrically coupled to the elevating device 14, the fluid pressure adjusting device 20, the supply valve 33, the discharge valve 34, the suction device 43, the on-off valve 44, the atmosphere release valve 46, and the pressure pump 32 such that the control device 50 can control them.

Figure 2:
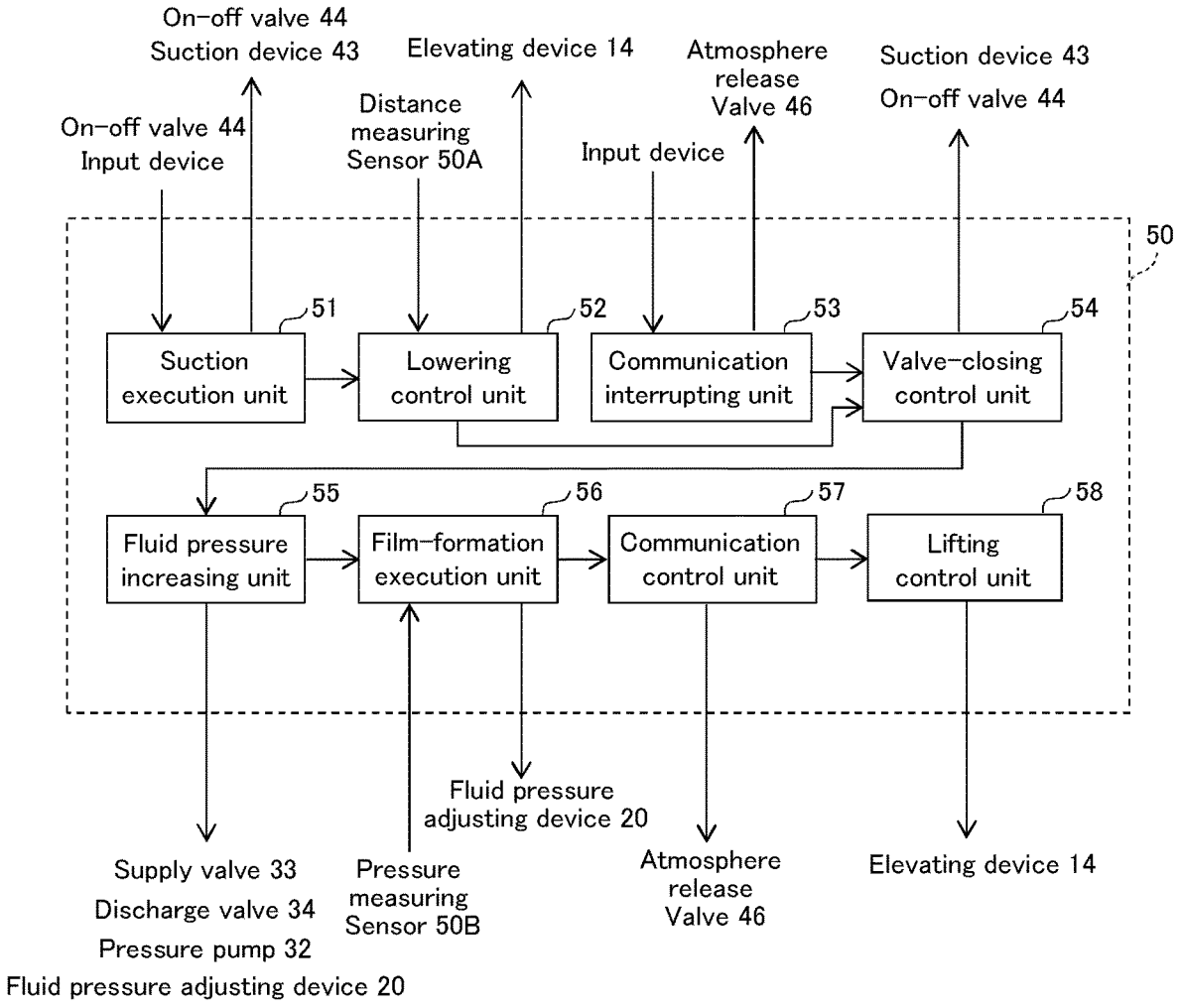
FIG. 2 is a block diagram of a control device of the film forming apparatus shown in FIG. 1.

As shown in FIG. 2, the control device 50 includes, as software, at least a suction execution unit 51, a lowering control unit 52, a valve-closing control unit 54, a fluid pressure increasing unit 55, and a film-formation execution unit 56. Furthermore, when the film forming apparatus 1 includes the atmosphere release valve 46, the control device 50 includes, as software, a communication interrupting unit 53, a communication control unit 57, and a lifting control unit 58.

First, in response to an input signal (instruction signal of starting film formation) from an input device, the control device 50 executes the following software process. The suction execution unit 51 executes suction by the suction device 43 in a state where the on-off valve 44 is open. Specifically, when the suction device 43 is a vacuum pump, for example, the suction execution unit 51 drives the vacuum pump in response to a signal indicating that the on-off valve 44 is open. It should be noted that although the on-off valve 44 is in the open position when the film forming apparatus is not driven, the suction execution unit 51 opens the on-off valve 44 when the on-off valve 44 is in the closed position. Furthermore, the suction execution unit 51 transmits a suction start signal indicating starting suction to the lowering control unit 52.

The lowering control unit 52 controls lowering of the housing 11 by the elevating device 14 to the position where the porous film 12 comes into contact with the substrate W based on an output signal of the distance measuring sensor 50A. After the elevating device 14 starts lowering the housing 11, at a timing when the distance measured by the distance measuring sensor 50A is equal to the preset distance, the lowering control unit 52 determines that the porous film 12 has come into contact with the substrate W. At this timing, the lowering control unit 52 stops the lowering by the elevating device 14 and transmits a lowering stop signal to the valve-closing control unit 54.

In the present embodiment, through such control, the porous film 12 can be moved toward the substrate W and brought into contact with the surface of the substrate W while the gas between the substrate W and the porous film 12 is sucked from the suction port 41 of the suction passage 42 formed on the mount base 13. Consequently, it is possible to prevent the gas (air) from being captured in between the substrate W and the porous film 12.

Before the suction execution unit 51 starts suction and until the lowering control unit 52 brings the porous film 12 into contact with the substrate W, the communication interrupting unit 53 controls the atmosphere release valve 46 to be closed to interrupt the suction passage 42 communicated to atmosphere. It should be noted that when the atmosphere release valve 46 is in the closed position, the communication interrupting unit 53 maintains the closed state of the atmosphere release valve 46. The valve-closing control of the atmosphere release valve 46 by the communication interrupting unit 53 may be performed, for example, in response to a film formation start input signal from an input device, or may be performed, for example, in response to a lowering start signal by the lowering control unit 52, though not shown in FIG. 2. As long as the valve-closing control of the atmosphere release valve 46 can be performed before the suction execution unit 51 starts suction and until the lowering control unit 52 brings the porous film 12 into contact with the substrate W, the valve-closing timing is not particularly limited. It should be noted that the communication interrupting unit 53 may transmit a signal indicating the completion of valve-closing of the atmosphere release valve 46 to the valve-closing control unit 54, as appropriate.

The valve-closing control unit 54 controls the on-off valve 44 to be closed after the lowering control unit 52 brings the porous film 12 into contact with the substrate W in the present embodiment. Specifically, in response to a lowering stop control signal of the lowering control unit 52 and, as appropriate, a valve-closing completion control signal of the communication interrupting unit 53, the valve-closing control unit 54 controls the on-off valve 44 to be closed. Alternatively, instead of the control signal, the valve-closing control unit 54 may control the on-off valve 44 to be closed directly in response to a detection signal from the distance measuring sensor 50A (i.e., a signal of detecting that the porous film 12 has come into contact with the substrate W) and, as appropriate, a closed state detection signal from the atmosphere release valve 46.

Herein, the valve-closing control unit 54 may stop suction by the suction device 43 or continue suction by the suction device 43 after closing the on-off valve 44. This interrupts the suction passage 42 (the flow of the gas flowing through the suction passage 42 is interrupted). Consequently, as will be described later, it is possible to suppress leakage of the electrolytic solution S via the porous film 12 caused by the suction during film formation, and thus stabilize the fluid pressure of the electrolytic solution S in the housing 11. The valve-closing control unit 54 transmits a valve-closing completion signal indicating that the valve-closing of the on-off valve 44 is completed to the fluid pressure increasing unit 55. The valve-closing control unit 54 may transmit a valve-closing completion signal in response to the closed state of the on-off valve 44 from the on-off valve 44 or may transmit a valve-closing control signal to the on-off valve 44 and then transmit a valve-closing completion signal after a lapse of a predetermined time.

After controlling the on-off valve 44 to be closed, the fluid pressure increasing unit 55 increases the fluid pressure of the electrolytic solution S by the fluid pressure adjusting device 20. Specifically, in response to a signal of the valve-closing control unit 54, the fluid pressure increasing unit 55 stops the driving of the pressure pump 32 and closes the supply valve 33 and the discharge valve 34 in the open position. This makes the interior of the housing 11 hermetically sealed.

Next, the fluid pressure increasing unit 55 moves the piston 22 of the fluid pressure adjusting device 20 toward the cylinder 21. Accordingly, the electrolytic solution S is pressure fed into the hermetically sealed housing 11, and then the electrolytic solution S stored in the housing 11 is pressurized. Consequently, the porous film 12 can be uniformly pressed against the substrate W with the fluid pressure of the electrolytic solution S during film formation. Furthermore, the fluid pressure increasing unit 55 transmits a fluid pressure increase signal indicating the increase in the fluid pressure to the film-formation execution unit 56.

The film-formation execution unit 56 forms the metal film F on the surface of the substrate W while maintaining the increased fluid pressure. Specifically, in response to a fluid pressure increase signal, the film-formation execution unit 56 receives a signal of the pressure measuring sensor 50B and, when the fluid pressure reaches a predetermined fluid pressure, stops the forward movement of the piston 22 of the fluid pressure adjusting device 20 based on the signal of the pressure measuring sensor 50B. This can maintain the predetermined fluid pressure. The range of the predetermined fluid pressure may be set in advance and stored in the storage unit of the control device 50, and the film-formation execution unit 56 may load the registered range of the predetermined fluid pressure from a registering unit.

It should be noted that when the fluid pressure changes in response to the signal of the pressure measuring sensor 50B during film formation, the film-formation execution unit 56 may control the fluid pressure adjusting device 20 to maintain the predetermined fluid pressure at a constant level. In addition, the film-formation execution unit 56 moves back the piston 22 of the fluid pressure adjusting device 20 with respect to the cylinder 21 when the film formation ends. This sucks the electrolytic solution S stored in the hermetically sealed housing 11 and thus the stored electrolytic solution S is decompressed. As a result, the electrolytic solution S in the pressurized state with the fluid pressure is released. Furthermore, the film-formation execution unit 56 transmits a film formation end signal indicating the end of film formation to the communication control unit 57.

After the film-formation execution unit 56 forms the metal film F, the communication control unit 57 controls the atmosphere release valve 46 to be open to allow the suction passage 42 to be communicated to atmosphere. This can reset the pressure in the suction passage 42 to the atmospheric pressure after film formation, even if it is maintained at a negative pressure due to the suction of a gas after the suction passage 42 is interrupted and until film formation is completed. Consequently, even if lifting of the housing 11 by the elevating device 14 is controlled, it is possible to reduce the likelihood that the porous film 12 is less likely to be separated from the substrate W due to the negative pressure in the suction passage 42. The communication control unit 57 receives the film formation end signal from the film-formation execution unit 56 and transmits a communication signal indicating that the suction passage 42 has been communicated to atmosphere to the lifting control unit 58.

After the suction passage 42 is allowed to be communicated to atmosphere by the communication control unit 57, the lifting control unit 58 controls the lifting of the housing 11 by the elevating device 14 until the porous film 12 is spaced apart from the substrate W. It should be noted that the lifting control unit 58 receives a communication signal from the communication control unit 57.

2. Regarding Film Forming Method for Forming Metal Film F

Figure 3:
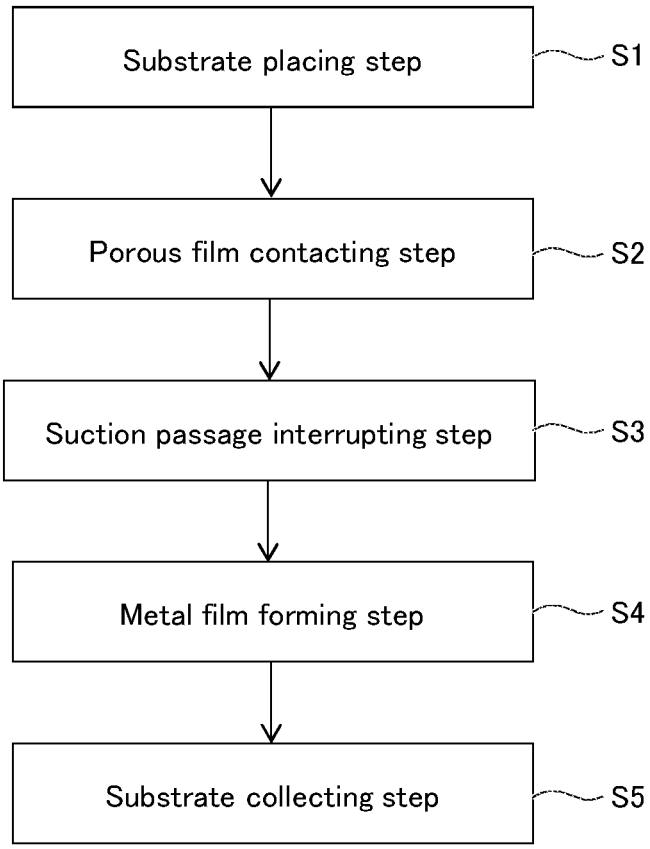
FIG. 3 is a flowchart of a film forming method for forming a metal film using the film forming apparatus shown in FIG. 1.

FIG. 3 is a flowchart of the film forming method for forming the metal film F using the film forming apparatus 1 shown in FIG. 1. FIG. 4 is a schematic conceptual view illustrating a film forming step S4 of forming the metal film F shown in FIG. 3. Hereinafter, the film forming method for forming the metal film F according to the first embodiment will be described with reference to the flow of the steps shown in FIG. 3.

2-1. Regarding Substrate W Placing Step S1

The film forming method for forming the metal film F according to the present embodiment first performs a substrate W placing step S1. In this step, as shown in FIG. 1, the substrate W is placed on the mount base 13. Specifically, while the housing 11 is disposed above the mount base 13, the substrate W is placed on the housing recess 13*a* of the mount base 13. Accordingly, the substrate W is placed in a position opposed to the porous film 12.

When the substrate W is placed, the supply valve 33 and the discharge valve 34 are opened and the pressure pump 32 is driven. Accordingly, the electrolytic solution S is supplied from the collection tank 31 into the housing 11 via the supply port 11*a*, then the electrolytic solution S having passed through the housing 11 is discharged from the housing 11 via the discharge port 11*b*, and the discharged electrolytic solution S is returned to the collection tank 31.

Though not shown, the control device 50 may further include a supply/discharge execution unit for supplying and discharging the electrolytic solution S as described above, and the supply/discharge execution unit may open the supply valve 33 and the discharge valve 34 and drive the pressure pump 32 as described above.

2-2. Regarding Porous Film 12 Contacting Step S2

Next, the method performs a porous film 12 contacting step S2. In this step, as shown in FIG. 1, while the suction execution unit 51 executes suction of the gas between the substrate W and the porous film 12 from the suction port 41 of the suction passage 42 formed on the mount base 13, the lowering control unit 52 moves the porous film 12 toward the substrate W to bring the porous film 12 into contact with the surface of the substrate W.

Specifically, in response to a film formation start input signal from an input device (not shown), the suction execution unit 51 drives the suction device 43. It should be noted that when the on-off valve 44 is in the open position before the suction device 43 is driven, the suction execution unit 51 maintains the open state of the on-off valve 44, whereas when the on-off valve 44 is in the closed position, the suction execution unit 51 opens the on-off valve 44. In the same manner, when the atmosphere release valve 46 is in the open position before the suction device 43 is driven, the communication interrupting unit 53 closes the atmosphere release valve 46, whereas when the atmosphere release valve 46 is in the closed position, the communication interrupting unit 53 maintains the closed state of the atmosphere release valve 46. This interrupts the suction passage 42 communicated to atmosphere via the communication passage 45, and allows suction of the gas or the like into the suction passage 42 via the suction port 41.

Once the suction execution unit 51 starts suction, the lowering control unit 52 drives the elevating device 14 to lower the housing 11 to the position where the porous film 12 uniformly comes into contact with the substrate W placed on the housing recess 13*a* based on an output signal of the distance measuring sensor 50A.

Through such a series of control in the porous film 12 contacting step S2, the gas sucked from the suction port 41 can be sucked into the suction passage 42 from the suction port 41 together with the electrolytic solution S having passed through the porous film 12. The gas having passed through the suction passage 42 flows into the gas-liquid separator 47 from the gas-liquid inlet port 47*a* and then is sucked by the suction device 43 via the gas outlet passage 48 from the gas outlet port 47*b* formed on the gas phase side. In this way, by sucking the gas between the substrate W and the porous film 12 until the porous film 12 comes into contact with the substrate W, it is possible to prevent the gas (air) from being captured in between the substrate W and the porous film 12 and uniformly bring the porous film 12 into contact with the surface of the substrate W.

Meanwhile, the electrolytic solution S separated from the gas in the gas-liquid separator 47 is introduced into the collection tank 31 from the liquid outlet port 47*c* formed on the liquid phase side via the liquid outlet passage 49. The electrolytic solution S stored in the collection tank 31 can be reused.

Herein, the gas phase of the gas-liquid separator 47 is at a negative pressure due to the suction device 43, and thus the gas contained in the liquid phase of the electrolytic solution S can easily be removed. Consequently, the pressure of the electrolytic solution S in the housing 11 can stably be increased in a film forming step S4, which will be described later, since a gas as a compressible fluid is separated from the electrolytic solution S to be returned to the housing 11 from the collection tank 31 for reuse.

2-3. Regarding Suction Passage 42 Interrupting Step S3

Next, the method performs a suction passage 42 interrupting step S3. In this step, the suction passage 42 is interrupted in a state where the porous film 12 is brought into contact with the surface of the substrate W in the contacting step S2 (see FIG. 4). Specifically, in response to a lowering stop signal of the housing 11 from the lowering control unit 52, the valve-closing control unit 54 closes the on-off valve 44 in the open position. This can prevent any more air and electrolytic solution S or the like from flowing into the suction passage 42.

The valve-closing control unit 54 transmits a valve-closing completion signal to the fluid pressure increasing unit 55 at a timing when the valve-closing is completed. Herein, the driving of the suction device 43 may be continued or the driving of the suction device 43 may be stopped at a timing when the on-off valve 44 is closed. This interrupts the suction passage 42 and thus stops the suction at the suction port 41.

2-4. Regarding Metal Film F Forming Step S4

Next, the method performs a metal film F forming step S4. In this step, as shown in FIG. 4, in a state where the suction passage 42 is interrupted, the electrolytic solution S is allowed to pass through the porous film 12 from one side of the porous film 12 while the porous film 12 is pressed against the surface of the substrate W with the fluid pressure of the electrolytic solution S. Accordingly, metal from the metal ions contained in the passed electrolytic solution S is deposited on the surface of the substrate W by electroless plating, thereby forming the metal film F on the surface of the substrate W.

Specifically, first, the fluid pressure increasing unit 55 having received the valve-closing completion signal stops the driving of the pressure pump 32 and closes the supply the valve 33 and the discharge valve 34 in the open position. This stops supplying and discharging the electrolytic solution S and makes the interior of the housing 11 hermetically sealed.

In this hermetically sealed state, the fluid pressure increasing unit 55 moves the piston 22 of the fluid pressure adjusting device 20 toward the cylinder 21. This increases the fluid pressure of the electrolytic solution S stored in the hermetically sealed housing 11. The fluid pressure increasing unit 55 transmits a fluid pressure increase signal to the film-formation execution unit 56.

The film-formation execution unit 56 having received the fluid pressure increase signal receives a pressure signal of the pressure measuring sensor 50B and, when the fluid pressure reaches a predetermined fluid pressure, stops the above-described forward movement of the piston 22 based on the received pressure signal. This can maintain the electrolytic solution S in the housing 11 at the predetermined fluid pressure, and thus the porous film 12 can be pressed against the substrate W being in contact with the porous film 12 with the maintained fluid pressure during film formation.

As a result, the porous film 12 is allowed to follow the surface of the substrate W, and to pass the electrolytic solution S therethrough while uniformly pressurizing the surface of the substrate W, whereby metal derived from metal ions contained in the electrolytic solution S can be deposited and the metal film F can be formed on the substrate W. It should be noted that the film thickness of the metal film F can be adjusted by setting in advance the contact time (specifically, metal deposition time) for which the porous film 12 is in contact with the substrate W.

In the present embodiment, as described above, since the metal film F is formed in a state where the suction passage 42 is interrupted, it is possible to reduce the likelihood that the electrolytic solution S passes through the porous film 12 due to suction. This can suppress shortage of the fluid pressure (applied pressure) caused by leakage of the electrolytic solution S. As a result, an excellent metal film F can be formed while ensuring a stable fluid pressure.

When the film formation ends, the film-formation execution unit 56 moves back the piston 22 of the fluid pressure adjusting device 20 with respect to the cylinder 21 to make the fluid pressure adjusting device 20 release the pressurized state with the fluid pressure. The film-formation execution unit 56 transmits a film formation end signal to the communication control unit 57.

2-5. Regarding Substrate W Collecting Step S5

Next, the method performs a substrate W collecting step S5. In this step, the interrupted suction passage 42 is allowed to be communicated to atmosphere, and after the suction passage 42 is communicated to atmosphere, the porous film 12 is separated from the substrate W having the metal film F formed thereon.

Specifically, the communication control unit 57 having received the film formation end signal opens the atmosphere release valve 46. This allows the suction passage 42 in the negative pressure state from the suction port 41 to the on-off valve 44 to be communicated to atmosphere via the communication passage 45, and makes the pressure in the suction passage 42 at the atmospheric pressure. The communication control unit 57 transmits a communication signal to the lifting control unit 58.

The lifting control unit 58 having received the communication signal controls the elevating device 14 to lift the housing 11 (see FIG. 1). In this way, it is possible to reset the pressure in the suction passage 42 to the atmospheric pressure after film formation, even if it is maintained at a negative pressure due to the suction of a gas after the suction passage 42 is interrupted and until film formation is completed. Consequently, even if the lifting of the housing 11 by the elevating device 14 is controlled, it is possible to reduce the likelihood that the porous film 12 is less likely to be separated from the substrate W due to the negative pressure in the suction passage 42 and prevent damage of the porous film 12.

Second Embodiment

Figure 5:
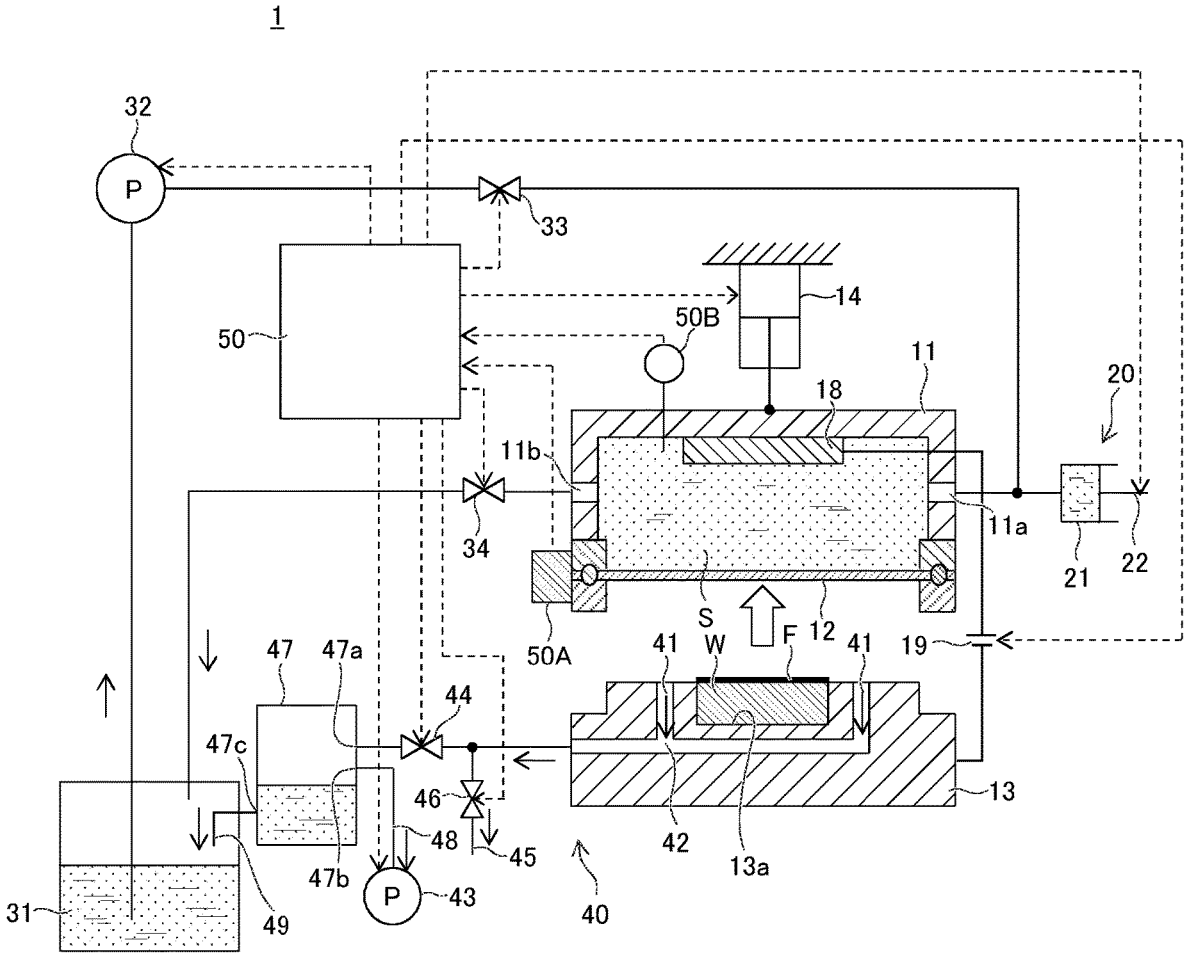
FIG. 5 is a schematic cross-sectional view of a film forming apparatus for forming a metal film according to a second embodiment of the present disclosure, illustrating the state of the film forming apparatus having a substrate mounted thereon after the film forming step of forming a metal film and before collecting the substrate.

With reference to FIG. 5, a film forming apparatus 1 and a film forming method for forming a metal film F according to the second embodiment will be described. FIG. 5 is a schematic cross-sectional view of the film forming apparatus 1 for forming the metal film F according to the second embodiment of the present disclosure, illustrating the state of the film forming apparatus 1 having the substrate W mounted thereon. Since the block diagram of the control device 50 of the film forming apparatus 1 according to the second embodiment is substantially equal to that of the first embodiment, only a difference in the block diagram of the control device according to the second embodiment will briefly be described.

The present embodiment is different from the first embodiment in that metal is deposited on the surface of the substrate W from the metal ions contained in the electrolytic solution S by electroplating. Therefore, the following mainly describes the difference, and the devices and parts equal to those of the foregoing first embodiment are denoted by the same reference numerals to omit detailed description thereof.

As shown in FIG. 5, the film forming apparatus 1 of the second embodiment includes a metal anode 18 and a power supply unit 19 that applies voltage across the anode 18 and the substrate W as a cathode, in addition to the components of the film forming apparatus 1 of the foregoing first embodiment. In the present embodiment, the porous film 12 is disposed between the anode 18 and the substrate W as a cathode, and a constant voltage is applied across the anode 18 and the substrate W by the power supply unit 19 in a state where the porous film 12 is in contact with the surface of the substrate W, thus allowing current to flow between the anode 18 and the substrate W during film formation. The substrate W is made of a conductive metal material, such as Cu, Ni, Ag, or Au, for example.

The anode 18 is housed in the housing 11 and the electrolytic solution S is disposed between the anode 18 and the porous film 12. When the anode 18 and the porous film 12 are spaced apart from each other, the anode 18 may be in the form of a plate, and may be either a soluble anode made of the same material (e.g., Cu) as the metal film F, or an anode made of a material (e.g., Ti) that is insoluble in the electrolytic solution S. Meanwhile, though not shown, when the anode 18 and the porous film 12 are in contact with each other, the anode 18 may be an anode made of a porous body that allows the electrolytic solution S to pass therethrough and supplies metal ions to the porous film 12.

It should be noted that when the anode 18 is pressed against the porous film 12, deposition may not be uniform due to variations in the pressing force of the anode 18 against the porous film 12. Thus, the anode 18 may be configured to be spaced apart from the porous film 12.

A negative electrode of the power supply unit 19 may be electrically coupled to the mount base 13 or, though not shown, may be electrically coupled to the substrate W, as long as it can be conductively coupled to the substrate W. However, when a nonconductive mount base 13 is used, specifically, the negative electrode may be electrically coupled to the substrate W. A positive electrode of the power supply unit 19 is electrically (conductively) coupled to the anode 18 incorporated into the housing 11. It should be noted that as long as film formation can be performed, the power supply unit 19 may be either a DC power supply or an AC power supply. The power supply unit 19 is electrically coupled to the control device 50 so that the control device 50 can control it.

The electrolytic solution S is not particularly limited as long as it is a solution containing metal ions of the metal to be deposited for the metal film F by electroplating. Examples of the metal of the metal ions may include Cu, Ni, Ag, or Au. In addition, the electrolytic solution S may contain such metal dissolved (ionized) with an acid, such as nitric acid, phosphoric acid, succinic acid, sulfuric acid, pyrophosphoric acid, or the like.

The configuration of the control device 50 of the present embodiment is equal to that of the control device 50 of the first embodiment. However, the film-formation execution unit 56 of the present embodiment is different from that of the first embodiment in that the film-formation execution unit 56 of the present embodiment controls voltage application by the power supply unit 19, in addition to the configuration of the first embodiment. Specifically, the film-formation execution unit 56 makes the power supply unit 19 apply voltage across the anode 18 and the substrate W to form the metal film F while maintaining the increased fluid pressure as described above. In addition, when the film formation ends, the film-formation execution unit 56 makes the fluid pressure adjusting device 20 release the pressurized state as described above and makes the power supply unit 19 release the application of voltage across the anode 18 and the substrate W.

The film forming method for forming the metal film F of the present embodiment is performed in the same manner as the film forming method of the foregoing first embodiment. However, the present embodiment is different from the first embodiment in that in the metal film F forming step, during film formation, the method performs application of voltage across the anode 18 and the substrate W and releasing of the application in the present embodiment.

Specifically, in the metal film F forming step of the present embodiment, first the fluid pressure of the electrolytic solution S in the housing 11 is increased by the fluid pressure increasing unit 55 and then the fluid pressure is maintained in a state where the suction passage 42 is interrupted as described above. While maintaining this state, the film-formation execution unit 56 makes the power supply unit 19 apply a constant voltage across the anode 18 and the substrate W to form the metal film F. This can form the metal film F derived from metal ions on the surface of the substrate W.

When the film formation ends, the film-formation execution unit 56 makes the fluid pressure adjusting device 20 release the pressurized state and makes the power supply unit 19 release the application of voltage across the anode 18 and the substrate W as described above. After that, the film-formation execution unit 56 transmits a film formation end signal to the communication control unit 57.

Also in the second embodiment, it is needless to mention that the same effect as the one produced by the film forming method and the film forming apparatus 1 for forming the metal film F described in the first embodiment can be obtained.

EXAMPLES

Hereinafter, examples of the present disclosure will be described.

Example

Using the film forming apparatus for forming the metal film of the first embodiment shown in FIG. 1, a metal film was formed by displacement plating along the film forming method for forming a metal film of the foregoing first embodiment. For an electrolytic solution and a porous film, an Au plating solution (TDS-25 available from C. Uyemura & Co., Ltd.) for displacement plating and a porous film (Poreflon WPW-045-80 available from Sumitomo Electric Industries, Ltd.) were used. A film formation process was conducted under a film formation time of 10 minutes, an applied pressure by a fluid pressure of 0.2 MPa. For a substrate, a Cu plate subjected to Ni plating was used.

When the gas between the substrate and the porous film was sucked in the porous film contacting step, the on-off valve was opened, the atmosphere release valve was closed, and the vacuum pump as a suction device was driven. In addition, in the suction passage interrupting step, the driving of the vacuum pump was maintained, and the on-off valve in the open position was closed. In this state, in the film forming step, a metal film was formed, and then the leakage of the electrolytic solution into the suction passage and the maintenance of pressure (fluid pressure) during film formation were confirmed. In addition, the film formation property of the formed metal film (Au film) was confirmed.

Comparative Example

In the same manner as Example, a metal film was formed, and then the leakage of the electrolytic solution into the suction passage, the maintenance of pressure, and the film formation property of the formed metal film were confirmed. However, Comparative Example was different from Example in that the suction passage interrupting step was not performed in Comparative Example. Specifically, in Comparative Example, in a state where the driving of the vacuum pump was maintained and the on-off valve was open, a metal film was formed.

[Result and Consideration]

When the suction passage was interrupted and the suction of a gas was stopped as in Example, liquid leakage of the electrolytic solution in the housing was suppressed. As a result, a constant pressure was maintained in the housing and an Au film was favorably formed on the substrate. In contrast, when the suction state of the suction passage was maintained as in Comparative Example, liquid leakage of the electrolytic solution in the housing via the porous film was found, and after a lapse of 1 minute from the start of film formation, a decrease in the pressure of the electrolytic solution in the housing was found. It was considered that the formation of the Au film was unfavorable for this reason.

Figure 6:
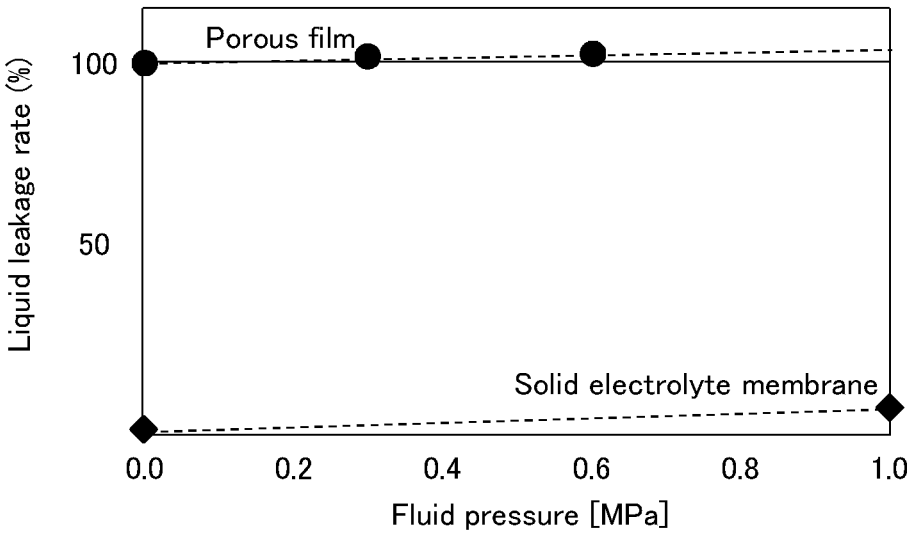
FIG. 6 is a graph showing a result of a liquid leakage rate of an electrolytic solution to an applied pressure to the substrate with the fluid pressure of the electrolytic solution when the film forming apparatus shown in FIG. 1 is used and a solid electrolyte membrane is used instead of the porous film of the film forming apparatus shown in FIG. 1.

Here, as a confirmation test, a liquid leakage rate when using the film forming apparatus shown in FIG. 1 and a liquid leakage when using a solid electrolyte membrane as a nonporous film instead of the porous film of the film forming apparatus shown in FIG. 1 were measured in a state where the vacuum pump was driven and the on-off valve was open. When measuring a liquid leakage rate, a pressure at each level shown in FIG. 6 was continuously applied to the substrate via the electrolytic solution at room temperature for 10 minutes in a state where a porous film or a nonporous film (solid electrolyte membrane) was in contact with the surface of the substrate. The results are shown in FIG. 6. It should be noted that the liquid leakage rate indicates a rate of the electrolytic solution in the suction passage to the volume of the interior of the suction passage. Furthermore, by using the film forming apparatus shown in FIG. 1, the electrolytic solution was heated at 70° C. and the applied pressure was maintained at 0.2 MPa, and a liquid leakage rate was measured for each pressurizing time shown in FIG. 7. It should be noted that when the pressurizing time was 0 minutes, the electrolytic solution was not pressurized. The results are shown in FIG. 7.

Figure 7:
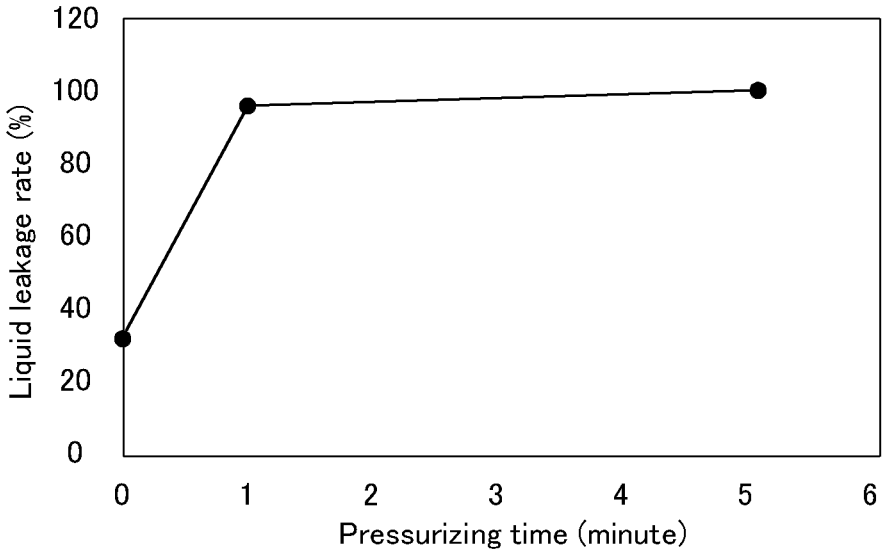
FIG. 7 is a graph showing a result of a liquid leakage rate of an electrolytic solution to a pressurizing time on the substrate in the film forming apparatus shown in FIG. 1.

As shown in FIG. 6, when a porous film was used, liquid leakage was confirmed, and as shown in FIG. 7, it was found that increasing the pressurizing time caused oozing of the electrolytic solution from the porous film even with a slight fluid pressure via the porous film. In view of these results, it is deemed that suction from the suction port may not be performed during film formation so that the electrolytic solution is less likely to ooze.

Although the embodiments of the present disclosure have been described in detail above, the present disclosure is not limited to the above embodiments, and various design changes can be made within the spirit and scope of the present disclosure recited in the claims.

For example, although the example of continuously interrupting the suction passage during film formation has been described in the above first and second embodiments, the present disclosure is not limited thereto, and the suction passage may be interrupted intermittently during film formation. This can remove a gas such as hydrogen, for example, if generated between the porous film and the substrate during film formation.

In addition, although the film forming apparatus including the gas-liquid separator in the suction unit has been described in the above first and second embodiments, as long as a fluid mixture of the sucked electrolytic solution and gas can be separated in the collection tank, for example, the gas-liquid separator may be omitted, and the collection tank may be coupled to the suction passage via the suction device.

What is claimed is:

1. A film forming method for forming a metal film from metal ions contained in an electrolytic solution on a surface of a substrate by depositing metal on the surface of the substrate by electroplating or electroless plating, the film forming method comprising at least:

placing the substrate on a mount base;

while sucking a gas between the substrate and a porous film from a suction port of a suction passage formed on the mount base, the suction passage connecting a suction pump to the suction port, moving the porous film toward the substrate and bringing the porous film into contact with the surface of the substrate;

stopping suction from the suction pump in the suction passage in a state where the porous film is in contact with the surface of the substrate; and in a state where suction in the suction passage is stopped, allowing the electrolytic solution to pass through the porous film while the porous film is pressed against the substrate with a fluid pressure of the electrolytic solution and depositing the metal from the metal ions contained in the passed electrolytic solution on the surface of the substrate, thereby forming the metal film on the surface of the substrate.

2. The film forming method for forming a metal film according to claim 1, wherein:

allowing the suction passage to be communicated to atmosphere after the forming the metal film; and separating the porous film from the substrate after the suction passage is communicated to the atmosphere.

3. The film forming method for forming a metal film according to claim 1, wherein in the bringing the porous film into contact with the surface of the substrate, separating, from the gas, the electrolytic solution having been sucked into the suction passage together with the gas during suction of the gas.

* * * * *